US007525507B1

(12) United States Patent
Henry, Jr.

(10) Patent No.: US 7,525,507 B1
(45) Date of Patent: Apr. 28, 2009

(54) ADJUSTABLE ANTENNA MOUNT WITH COVERED RATCHET

(75) Inventor: Donald I. Henry, Jr., Newberry, SC (US)

(73) Assignee: Shakespeare Company, LLC, Greer, SC (US)

( * ) Notice: Subject to any disclaimer, the term of this patent is extended or adjusted under 35 U.S.C. 154(b) by 0 days.

(21) Appl. No.: 12/001,007

(22) Filed: Dec. 7, 2007

(51) Int. Cl.
*H01Q 3/02* (2006.01)

(52) U.S. Cl. ..... 343/882; 343/869; 343/872; 343/888

(58) Field of Classification Search ..... 343/878, 343/880–882
See application file for complete search history.

(56) References Cited

U.S. PATENT DOCUMENTS

| | | | | | |
|---|---|---|---|---|---|
| 3,819,136 | A | | 6/1974 | Finke | 248/42 |
| 3,886,560 | A | | 5/1975 | Mortensen et al. | 343/882 |
| 4,115,779 | A | * | 9/1978 | Dantzler et al. | 343/715 |
| 4,282,526 | A | | 8/1981 | Alf et al. | 343/715 |
| 4,538,155 | A | | 8/1985 | Stewart | 343/715 |
| 5,248,986 | A | | 9/1993 | Marshall | 343/715 |
| 5,402,135 | A | * | 3/1995 | DeMarre et al. | 343/715 |
| 5,417,178 | A | | 5/1995 | Harrelson, II | 114/343 |
| 5,459,476 | A | * | 10/1995 | Hsieh | 343/882 |
| 5,506,593 | A | * | 4/1996 | Peng | 343/888 |
| 5,512,912 | A | | 4/1996 | Ross et al. | 343/765 |
| 6,157,345 | A | * | 12/2000 | Hockett et al. | 343/715 |
| 6,486,842 | B2 | * | 11/2002 | Wang | 343/715 |
| D470,838 | S | * | 2/2003 | Kim | D14/234 |
| 7,068,232 | B2 | | 6/2006 | Duncan et al. | 343/715 |
| 2004/0179891 | A1 | | 9/2004 | Watkins et al. | 403/96 |
| 2006/0096770 | A1 | | 5/2006 | Roberts | 173/217 |

OTHER PUBLICATIONS

Navigation, Instruments & Electronics catalog; http://www.paynesmarine.com/documents/Aonline_007.pdf: pp. 13, 14, 16, and 18-20; publication date unknown, but sufficiently earlier than the effective U.S. filing date.

* cited by examiner

*Primary Examiner*—Vibol Tan
(74) *Attorney, Agent, or Firm*—Renner Kenner Greive Bobak Taylor & Weber

(57) ABSTRACT

An antenna mounting system for a vehicle that allows easy adjustments without the need of additional tools after initial installation. The antenna mount comprises internal interlocking teeth between an antenna base and a link arm that engage with the tightening of a fastener. The antenna mount also includes internal interlocking teeth between the link arm and an antenna arm. Forceable movement of a lever causes an arm cam and hub cam to allow a biasing spring to disengage the link arm teeth from the antenna arm teeth. In this condition, the antenna arm is allowed to be rotatably moved into a desired orientation whereupon the lever arm can re-engage the cams and with one another so as to tighten and maintain a selected orientation. In addition to the internal interlocking teeth, antenna arm has a skirt to further preclude contaminants from entering the area where the teeth and teeth engage one another.

17 Claims, 5 Drawing Sheets

ADJUSTABLE ANTENNA MOUNT WITH COVERED RATCHET

TECHNICAL FIELD

The present invention is directed to an antenna mounting system. In particular, the invention is directed to antenna systems that allow the orientation of the antenna to be adjusted in two different planes of motion.

BACKGROUND ART

Adjustable antenna mounts are widely known in the art. Adjustable antenna mounts are frequently applied to boats and other water vehicles. Upon a larger vessel, it is often required to have the antenna upright for long periods of time while the boat is in open water. Inasmuch as some antennas may be directionally sensitive, it is advantageous to mount the antenna so that it can be rotated when desired. When the boat enters a harbor and passes under bridges, it is necessary to have the antenna mounted so that it can be quickly pivoted into the horizontal or other non-interfering position and locked into place. Therefore, a suitable antenna mount permits the antenna to be locked in the upright position and also allows the antenna to be locked in the non-interfering position.

One commercially available antenna mount addresses the issues of mounting the antenna in a desired orientation and changing the orientation when mandated by particular circumstances. Shakespeare Model 4187 antenna mount includes exposed ratcheting mechanisms that allow the antenna to be adjusted in two directions. However, the ratcheting mechanism is unprotected and can corrode and wear over time due to weather exposure. In addition, the exposed teeth of the ratcheting mechanism can be obstructed by other objects causing difficulties in operation. And the pitch angle of the teeth is about 10° which allows only crude adjustment of the ratcheting mechanism. Any finer pitch angle was thought not to be usable as the finer teeth would become too easily corroded. Lastly, the exposed teeth of the ratchet can potentially come in contact with a person or article of clothing causing a safety concern in its adjustments.

DISCLOSURE OF INVENTION

In light of the foregoing, it is a first aspect of the present invention to provide an adjustable antenna mount with covered ratchet.

Another aspect of the present invention is to provide an improved antenna mount with a non-exposed ratchet design that improves overall durability and reliability by incorporating the structure of interlocking teeth into a closed cover design.

Yet another aspect of the present invention is to provide an antenna mount that can easily be adjusted along at least one axis without the use of additional tools after initial installation.

Still another aspect of the present invention is to provide a streamline, four-way ratchet mount that features a nutless design with standard threads.

Yet another aspect of the present invention is to provide an antenna mounting system comprising a base assembly having a mounting plate and a vertically extending collar, the collar having a base socket centrally disposed within a plurality of collar teeth, a link arm having a base end and an antenna end, the base end having a plurality of base teeth mateable with the collar teeth and a base end hole extending therethrough and alignable with the base socket, the antenna end having a plurality of arm teeth on one side, at least one arm cam positioned on an opposite side and an antenna end hole extending therethrough, a first fastener received by the base end hole and the base socket securing the base assembly to the link arm and mating and meshing the collar teeth with the base teeth, an antenna arm having a mount adapted to receive an antenna, a plurality of antenna arm teeth mateable to the arm teeth of the link arm, and an antenna socket alignable with the antenna end hole of the link arm, a locking handle having a hub and a lever extending from the hub, the hub having at least one hub cam engageable with at least one arm cam and a hub hole extending therethrough alignable with the antenna end hole, a second fastener received by the hub hole, the antenna arm end hole, and the antenna socket and mating and meshing the arm teeth of the link arm with the antenna arm teeth of the antenna arm, and a spring disposed between the antenna arm and the antenna end of the link arm while the second fastener is received through the respective holes.

BRIEF DESCRIPTION OF THE DRAWINGS

For a complete understanding of the objects, techniques and structure of the invention, reference should be made to the following detailed description and accompanying drawings, wherein.

PREFERRED EMBODIMENT FOR CARRYING OUT THE INVENTION

Figure 2:
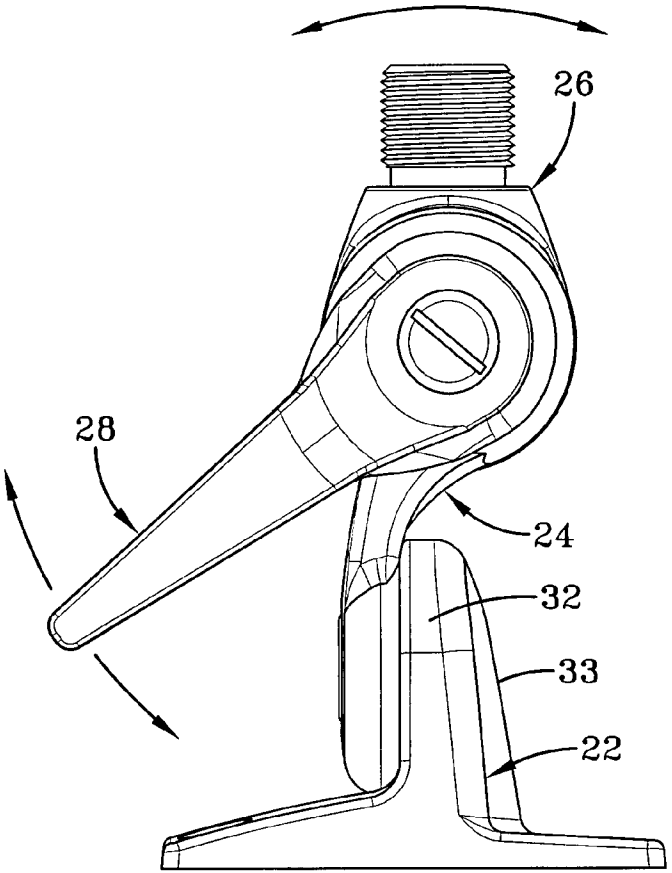
FIG. 2 is a front elevational view of the antenna mount.
Figure 1:
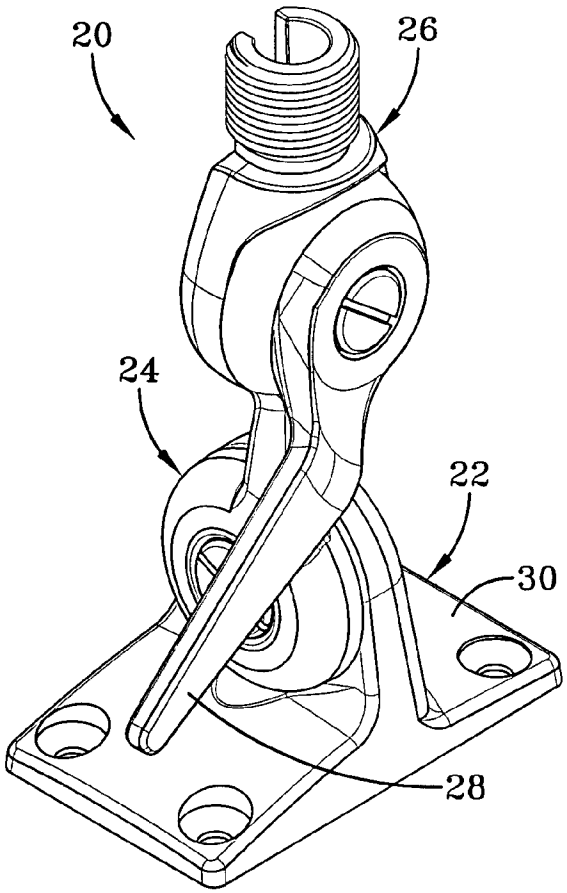
FIG. 1 is a front perspective view of an antenna mount according to the present invention.
Figure 3:
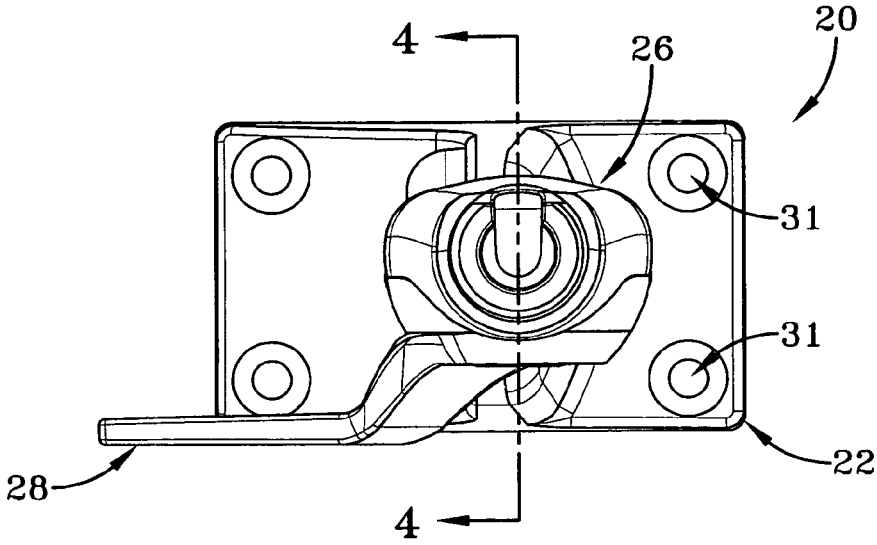
FIG. 3 is a top view of the antenna mount.
Figure 4:
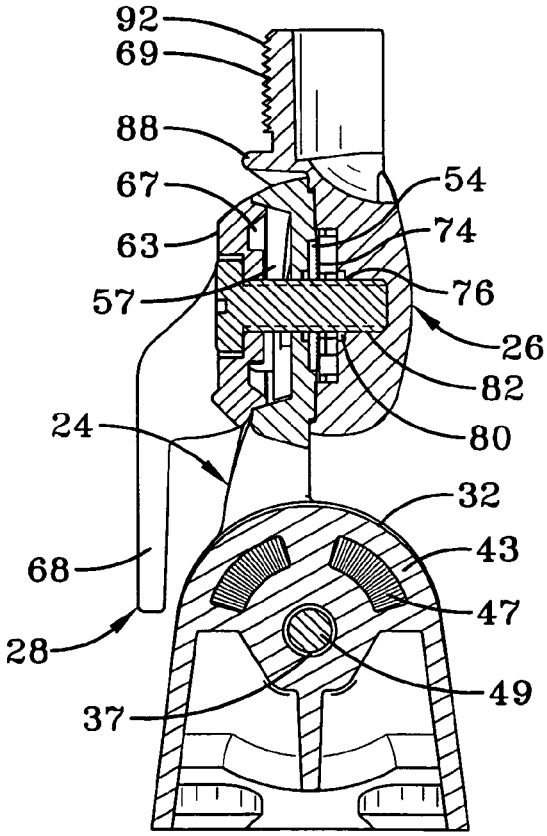
FIG. 4 is a cross-section view of the antenna mount taken along lines 4-4 of FIG. 3.
Figure 6:
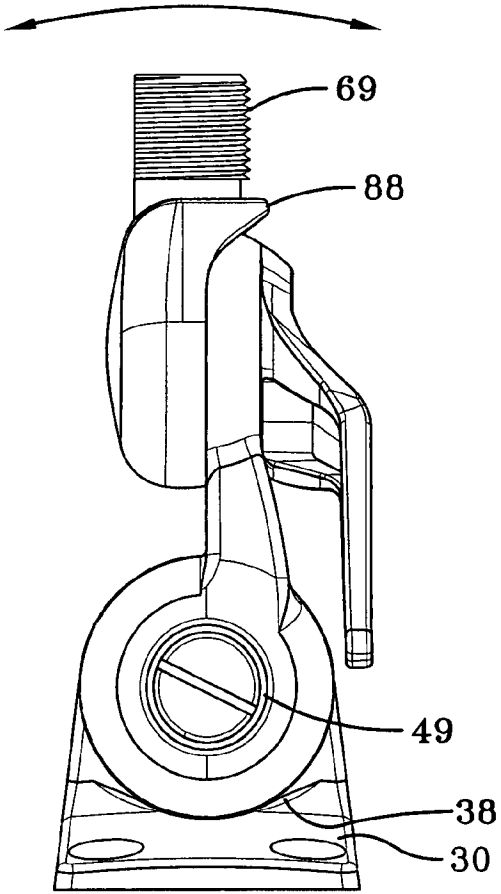
FIG. 6 is an opposite side view of the antenna mount.
Figure 5:
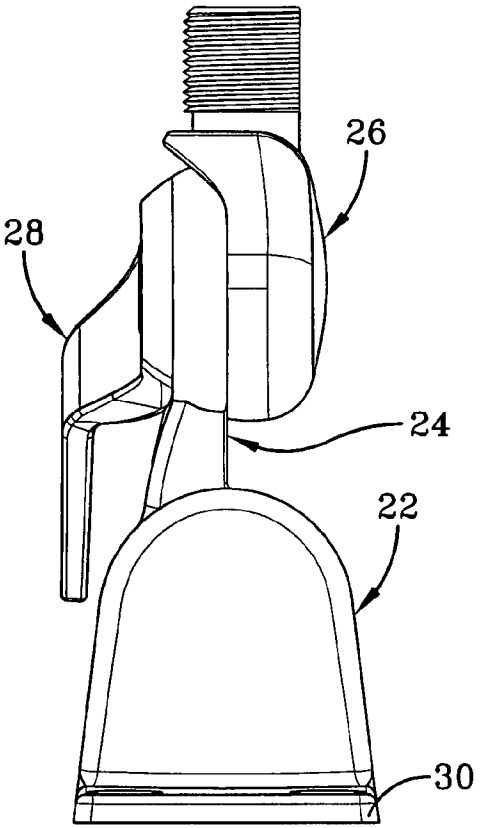
FIG. 5 is a side view of the antenna mount.

Referring now to all of the drawings, and specifically to FIGS. 1-4, it can be seen that an antenna mount is designated generally by the numeral 20. The mount 20 includes a base assembly 22 which is mountable upon any appropriate surface of a vehicle such as an automobile, boat or the like. Pivotably mounted with respect to the base assembly is a link arm 24. As will be described in further detail below, the link arm 24 allows for the antenna mount to be positionable in one orientational plane. An opposite end of the link arm 24 is connected to an antenna arm 26 which allows for orientational positioning of the antenna mount in a plane substantially orthogonal to the plane of orientation provided by the link arm 24. Coupled to the antenna arm 26 is a locking handle 28 which allows for release and re-positioning of the antenna arm 26 as needed. As will be appreciated by the skilled artisan, the locking handle 28 allows for relatively easy re-positioning of the antenna arm so that the antenna mounted to the antenna arm can be easily re-positioned so that it does not interfere with movement of the vehicle. In contrast, the rotational movement of the link arm 24 with respect to the base assembly 22 is allowed, but not as easily facilitated as the link arm by use of the locking handle.

Figure 7:
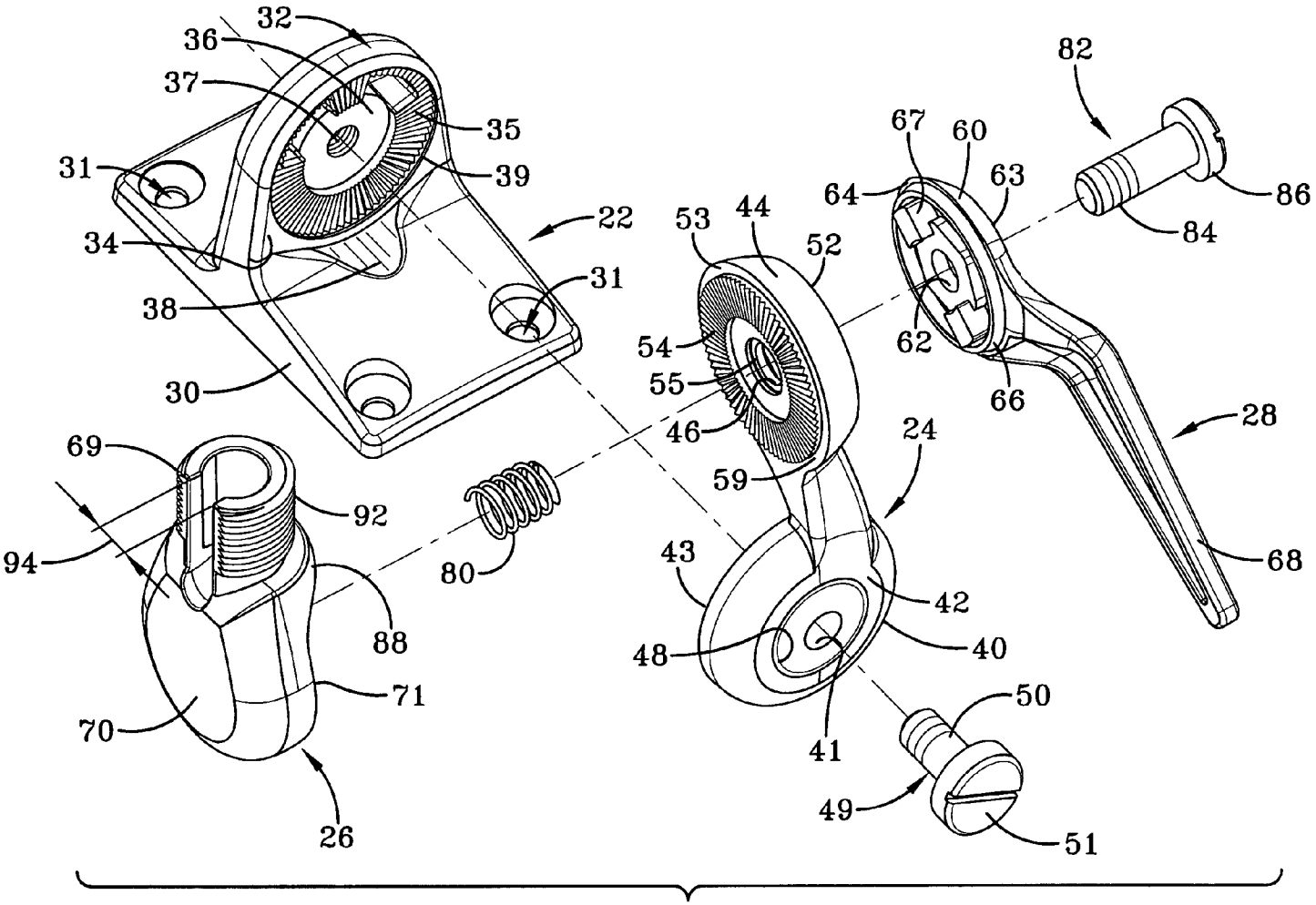
FIG. 7 is a side perspective exploded view of the antenna mount.
Figure 8:
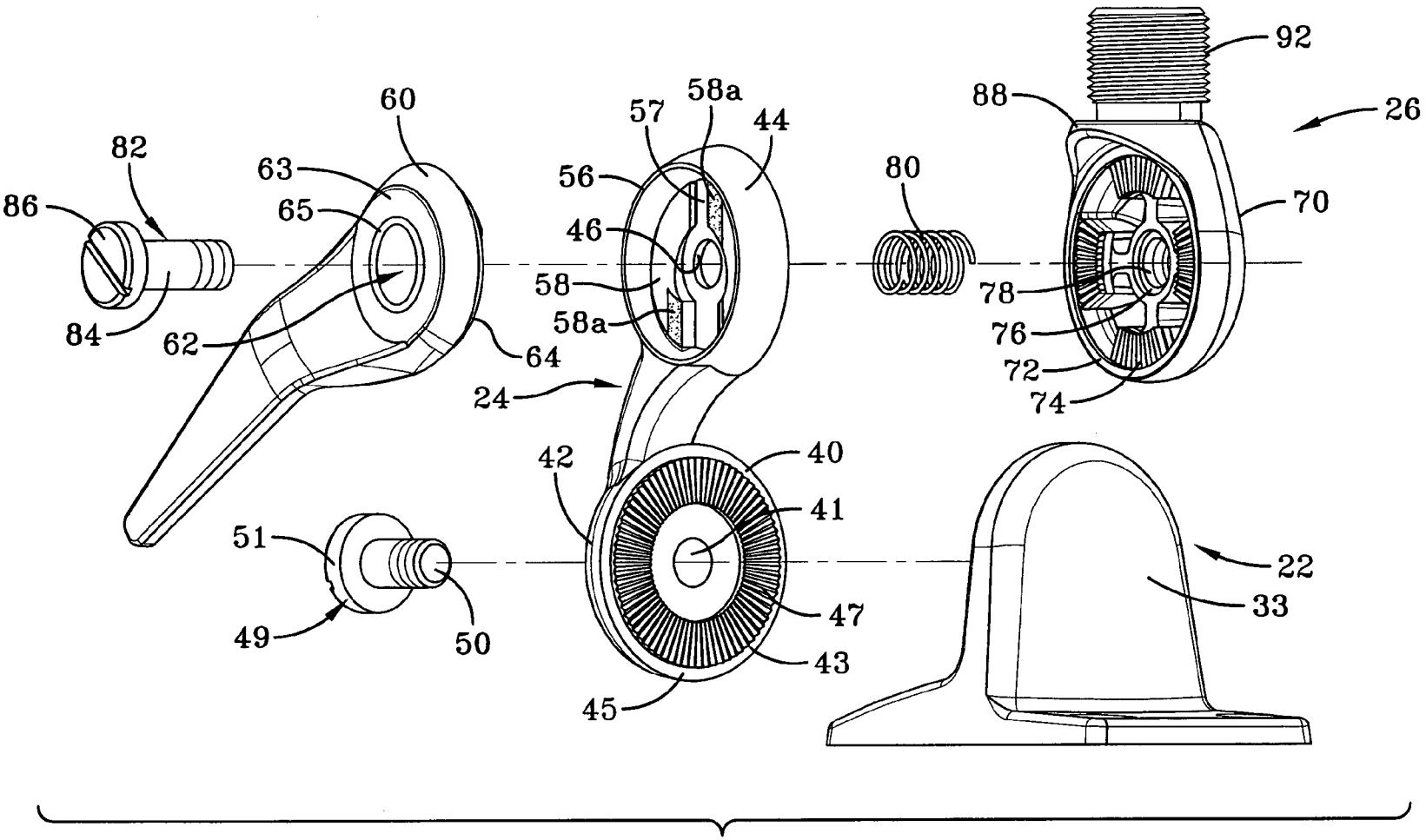
FIG. 8 is an opposite side perspective exploded view of the antenna mount.

As best seen in FIGS. 7 and 8, and with reference to the other Figs., the base assembly 22 includes a mounting plate 30 mountable to a surface of a water craft or other vehicle by securing bolts through bolt holes 31. A vertically extending collar 32 extends from the mounting plate 30. The collar 32 provides a smooth closed side 33 which is opposite an engagement side 34. The engagement side 34 includes a plurality of collar teeth 35 which are disposed in a circular arrangement. Centrally disposed within the collar teeth 35 is a recessed surface 36 which provides a threaded socket 37. In some embodiments, the socket 37 may extend all the way through the collar 32. It will also be appreciated that the collar 32 provides a retention groove 38 which is partially formed in the mounting plate 30. The groove 38 allows full circular formation of the collar teeth 35. Surrounding the collar teeth 35 is a raised perimeter surface referred to as collar rim 39, which will be further discussed below.

The link arm 24 provides a base end 40 which has a hole 41 extending therethrough. The base end 40 provides a fastener side 42 opposite a mesh side 43. Base end 40 is sized so as to mate with the engagement side 34 and fit within the retention groove 38. Opposite the base end 40 is an antenna end 44 which has a hole 46 extending therethrough. Mesh side 43 of the base end 40 has a plurality of base teeth 47 which mate and mesh with the collar teeth 36. Surrounding the base teeth 47 is a base lip 45 that the collar rim 39 contacts as the base teeth 47 mate and mesh with the collar teeth 35. The base lip 45 enables the collar rim 39 to border the periphery of the base teeth 47 to form an internal locking structure. The fastener side 42 of the base end 40 has a countersink 48.

A fastener 49 is receivable in the hole 41 and threaded socket 37 so as to allow for attachment of the link arm 24 to the vertical collar 32. Moreover, the fastener 49 includes a threaded shaft 50, which engages the threaded socket 37, and a head 51 extending from the shaft and receivable in the countersink 48. When the fastener 49 is tightened, it will be appreciated that the base teeth 47 mesh with the collar teeth 35 so as to prevent rotatable movement of the link arm 24. However, when the fastener 49 is loosened, rotatable movement of the link arm 24 is allowed by disengaging the teeth from one another until a desired orientational position of the link arm 24 is obtained and whereupon the fastener 49 is re-tightened. Since threaded shaft 50 secures to threaded socket 37, a nut and bolt design utilized in prior art design is no longer necessary. Threaded shaft 50 provides threads sized to mate with threaded socket 37 and includes a head 51 to allow tightening or loosening by use of a screwdriver or coin. It should also be appreciated that head 51 may comprise a Torx™ head, Allen head, or Philips head design as an alternative to the embodiment. And it will be appreciated that the head 51 is sized to have a thickness substantially the same as the depth of the countersink 48. As a result, the head 51 and the fastener side 42 provide a relatively flush or smooth surface that can be easily cleaned and does not easily accumulate debris.

The antenna end 44 provides a fastener side 52 opposite a mesh side 53. The mesh side 53 provides a plurality of arm teeth 54 that are arranged in a circular configuration. Surrounding the arm teeth 54 is an arm lip 59, which will be further discussed below. The mesh side 53 also provides a recessed lip surface 55 that is concentrically disposed within the arm teeth 54 and around the hole 46. The fastener side 52 provides an outer rim 56 that extends axially from an internal surface 57. Disposed around the hole 46 and within the outer rim 56, and extending from the internal surface 57, are at least two arcuate arm cams 58. As will be appreciated by the skilled artisan, the arm cams 58 have a changing dimensional thickness at different radial positions of the cam. In other words, the cam 58 provides a minimal thickness at one end and a maximum thickness at an opposite end. It will further be appreciated that the maximum thickness of one cam 58 is positioned adjacent the minimal thickness of the adjacent cam. Each cam 58, in the area of it's maximum thickness, includes a flat 58*a*. In some embodiments, the flat may be textured, serrated or otherwise finished to provide a gripping surface.

The locking handle 28 is aligned so as to be positioned adjacent the antenna end 44 and facing the arm cams 58. The locking handle 28 includes a hub 60 which has a hub hole 62 extending therethrough. The hub 60 provides a fastener side 63 opposite a cam side 64. And the fastener side 63 includes a countersink 65. The cam side 64 includes an inset collar edge 66 that is rotatably receivable within the outer rim 56. Contained within the collar edge 66 are a number of hub cams 67, wherein the number of hub cams corresponds to the number of arm cams 58 provided by the link arm 24. The hub cams 67 are spaced from one another in equal angular increments. In the embodiment shown, the hub cams are spaced about 180 degrees apart. Extending from the hub 60 is a lever 68.

The antenna end 44 is rotatably attached to the antenna arm 26. The antenna arm 26 includes a mount 69 which receives the antenna. The antenna arm 26 provides a smooth side 70 opposite an arm side 71. The arm side 71 includes a ridge 72 that is sized to be positioned adjacent the mesh side 53. Recessed from the ridge 72 are a plurality of antenna arm teeth 74 which mesh with the arm teeth 54 of the link arm 24 when assembled. The antenna arm teeth 74 are radially positioned around the periphery of the arm side 71 and, in this embodiment, are provided in segments disposed about 55 degrees from one another. The ridge 72 contacts the arm lip 59 as the antenna teeth 74 mate and mesh with the arm teeth 54. The arm lip 59 enables the ridge 72 to border the periphery of the arm teeth 54 to form an internal locking structure. Centrally disposed within the arm side 71 is a recessed surface 76 which provides a threaded socket 78. In some embodiments, the socket 78 may extend all the way through to the smooth side 70.

A spring 80 is disposed between the antenna arm 26 and the antenna end 44 of the link arm 24. Respective ends of the spring 80 are received in the recessed surface 76 and the recessed lip surface 55 for the purpose of retaining the spring 80. A fastener 82 providing a threaded shaft 84 and a head 86, much like the fastener 49, is used to assemble the locking handle 28, the antenna arm 26 and the link arm 24 to one another. It should be noted that an adhesive or bonding compound may be applied to the threads to limit the travel of fasteners 49 and 82. When assembled, the head 86 is substantially flush with the fastener side 63. Forceable movement of the lever 68 causes the arm cam 58 and hub cam 67 to allow the spring 80 to disengage the arm teeth 54 from the antenna arm teeth 74. In other words, rotation of the lever 68 causes the hub cams 67 to engage the arm cams 58. As a result of the changing thickness of the arm cams 58 and the bias force of the spring 80, the antenna arm 26 is disengaged from the link arm 24. In this condition, the antenna arm 26 is allowed to be rotatably moved into a desired orientation whereupon the lever 68 is rotated in such a manner as to re-engage the cams 67 and 54 with one another so as to tighten and maintain a selected orientation. During the tightening process, the hub cams 67 engage the respective arm cams 58 and attain a locking position of the flat 58*a*, wherein the hub cams 67 may be frictionally retained if the flat 58 provides a gripping type surface. In addition to the internal interlocking teeth, antenna arm 26 has a skirt 88 to further preclude contaminants from entering the area where the arm teeth 54 and antenna teeth 74 engage one another.

As noted previously, the teeth 54 mesh with the teeth 74 to allow the antenna arm 26 to be positionally adjusted with respect to the link arm 24. In a similar manner, the teeth 47 mesh with the teeth 35 to allow the link arm 24 to be positionally adjusted with respect to the base assembly 22. The teeth 54, 74, 47 and 35 all have a pitch angle of about 5°, although in some embodiments, all of the teeth could have a pitch angle as small as 2° or as large as 8°. Use of such a pitch angle allows for finer positioning of the antenna arm, the link arm and the base assembly with respect to one another.

The mount 69 includes threads 92 to receive an antenna, and includes at least one cable slot 94 that eliminates removal of most factory installed connectors. Cable slot 94 is located at the backside of mount 69 and extends axially downward to the bottom of mount 69. It should be noted that cable slot 94 can vary in length and width; however the width is narrow enough to provide adequate surface area for threads 92 to hold the mating surface of an antenna coupling.

A number of advantages of the present invention over the prior art are readily apparent. In contrast to the prior art, threaded sockets are provided to receive the fasteners. As such, the fasteners are less easily corroded. And the ends of the fastener do not protrude which would otherwise snag clothing or other items. Indeed, the inventive antenna mount does not utilize a nut configuration to receive the fasteners, but instead uses a socket to further streamline the antenna mount. Another advantage is that the fastener heads are substantially flush with other components of the antenna. This also reduces the possibility of corrosion adversely affecting operation of the antenna mount. Still another advantage is that the mating teeth of the various components are internally maintained and not exposed. Accordingly, since the meshing teeth are enclosed and less susceptible to corrosion, they can be provided with a pitch angle that allows for finer adjustment of inter-related components.

Although the antenna mounting system has been described in considerable detail with reference to certain preferred versions thereof, other versions would be readily apparent to those of ordinary skill in the art. Therefore, the spirit and scope of the appended claims should not be limited to the description of the preferred versions contained herein.

What is claimed is:

1. An antenna mounting system comprising:

a base assembly having a mounting plate and a vertically extending collar, said collar having a base socket centrally disposed within a plurality of collar teeth;

a link arm having a base end and an antenna end, said base end having a plurality of base teeth mateable with said collar teeth and a base end hole extending therethrough and alignable with said base socket, said antenna end having a plurality of arm teeth on one side, at least one arm cam positioned on an opposite side and an antenna end hole extending therethrough;

a first fastener received by said base end hole and said base socket securing said base assembly to said link arm and mating and meshing said collar teeth with said base teeth;

an antenna arm having a mount adapted to receive an antenna, a plurality of antenna arm teeth mateable to said arm teeth of said link arm, and an antenna socket alignable with said antenna end hole of said link arm;

a locking handle having a hub and a lever extending from said hub, said hub having at least one hub cam engageable with said at least one arm cam and a hub hole extending therethrough alignable with said antenna end hole;

a second fastener received by said hub hole, said antenna arm end hole, and said antenna socket and mating and meshing said arm teeth of said link arm with said antenna arm teeth of said antenna arm; and a spring disposed between said antenna arm and said antenna end of said link arm while said second fastener is received through said respective holes.

2. The antenna mounting system according to claim 1, wherein said mount further comprises external threads to receive the antenna and at least one cable slot transversely extending through said external threads.

3. The antenna mounting system according to claim 1, wherein said mounting plate of the base assembly includes a retention groove.

4. The antenna mounting system according to claim 1, wherein said antenna arm further comprises a skirt positioned such that it extends over where said antenna end of link arm mates with said antenna arm and said locking handle.

5. The antenna mounting system according to claim 1, wherein said collar teeth and said base teeth are internal interlocking teeth.

6. The antenna mounting system according to claim 1, wherein said arm teeth and said antenna teeth are internal interlocking teeth.

7. The antenna mounting system according to claim 1, wherein said first fastener is a bolt.

8. The antenna mounting system according to claim 7, wherein said base socket is a recessed threaded cavity.

9. The antenna mounting system according to claim 1, wherein said second fastener is a bolt.

10. The antenna mounting system according to claim 1, wherein said antenna socket is a recessed threaded cavity.

11. The antenna mounting system according to claim 1, wherein forceable movement of said lever causes disengagement of said arm cam and said at least one hub cam which allows said spring to disengage said arm teeth from said antenna teeth and rotatably re-orients said antenna arm into a desired orientation whereupon said lever can re-engage said at least one arm cam and said at least one hub cam with one another so as to tighten and maintain a selected orientation of said antenna arm with said link arm.

12. The antenna mounting system according to claim 11, wherein said arm cam is arcuate and a changing dimensional thickness at different radial positions of said arm cam, said arm cam having a textured flat.

13. The antenna mounting system according to claim 1, wherein loosening of said first fastener causes said base teeth to disengage from said collar teeth and allows said link arm to rotatably move into a desired orientation whereupon said first fastener can be re-tightened to maintain a selected orientation.

14. The antenna mounting system according to claim 1, wherein said antenna arm includes a ridge that radially surrounds the outer perimeter of said antenna teeth; and said link arm includes a lip that radially surrounds the outer perimeter of said arm teeth and abuts to said ridge providing said ridge to border the periphery of said arm teeth.

15. The antenna mounting system according to claim 1, wherein said vertically extending collar includes a rim that radially surrounds the outer perimeter of said collar teeth; and said link arm includes a lip that radially surrounds the outer perimeter of said base teeth and abuts to said rim providing said rim to border the periphery of said base teeth.

16. The antenna mounting system according to claim 1, wherein said locking handle includes a collar edge that radially surrounds said at least one hub cam; and said link arm includes an outer rim that radially surrounds said at least one arm cam; and wherein said outer rim borders the periphery of said collar edge as said at least one hub cam mates with said at least one arm cam.

17. The antenna mount according to claim 1, wherein said base teeth and said collar teeth, and said arm teeth and said antenna teeth, have a pitch angle of about 5°.

* * * * *